US007036202B2

(12) United States Patent
Lorenz

(10) Patent No.: US 7,036,202 B2
(45) **Date of Patent: *May 2, 2006**

(54) APPARATUS AND METHOD FOR HANDLING OF TUBULARS

(75) Inventor: Georg Lorenz, Burgwedel (DE)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/408,964

(22) Filed: Apr. 8, 2003

(65) Prior Publication Data

US 2003/0167623 A1 Sep. 11, 2003

Related U.S. Application Data

(63) Continuation of application No. 09/600,764, filed as application No. PCT/GB99/00432 on Feb. 11, 1999, now Pat. No. 6,550,128.

(30) Foreign Application Priority Data

Feb. 14, 1998 (GB) ..... 9803115

(51) Int. Cl.
*B25B 27/00* (2006.01)
*E21B 19/18* (2006.01)

(52) U.S. Cl. ..... 29/464; 29/272; 29/281.1; 269/43; 269/44; 269/45; 166/77.51; 414/22.71

(58) Field of Classification Search ..... 29/559, 29/272, 281.1, 281.5, 282, 464, 466, 468; 166/77.51, 85.1, 85.5, 379, 380, 381, 382, 166/383; 414/22.63, 22.65, 22.68, 22.71; 269/43, 44, 45

See application file for complete search history.

(56) References Cited

U.S. PATENT DOCUMENTS

| | | | | | |
|---|---|---|---|---|---|
| 731,665 | A | | 6/1903 | Clayton | |
| 2,147,002 | A | | 2/1939 | Volpin | |
| 3,633,771 | A | | 1/1972 | Woolslayer et al. | 214/2.5 |
| 4,074,897 | A | | 2/1978 | Behn | 269/43 |
| 4,291,762 | A | | 9/1981 | Gudgel | 166/85 |
| 4,295,527 | A | * | 10/1981 | Russe | |
| 4,442,892 | A | | 4/1984 | Delesandri | 166/85 |
| 4,575,061 | A | * | 3/1986 | Dille | |
| 4,625,796 | A | | 12/1986 | Boyadjieff | 166/77.5 |
| 4,650,235 | A | | 3/1987 | Shaginian et al. | 294/88 |
| 4,652,195 | A | * | 3/1987 | McArthur | |
| 4,750,662 | A | | 6/1988 | Kagimoto | 228/44.5 |
| 4,769,889 | A | | 9/1988 | Landman et al. | 29/237 |
| 4,779,856 | A | | 10/1988 | Beeler | 269/45 |
| 4,834,604 | A | * | 5/1989 | Brittain et al. | |
| 5,060,542 | A | * | 10/1991 | Hauk | |
| 5,206,980 | A | * | 5/1993 | Chapman | |
| 5,255,751 | A | | 10/1993 | Stogner | 175/203 |
| 5,575,344 | A | | 11/1996 | Wireman | 175/85 |
| 5,575,416 | A | | 11/1996 | Oellerer et al. | 228/49.1 |
| 5,727,778 | A | | 3/1998 | Nodar | 269/43 |
| 5,806,589 | A | | 9/1998 | Lang | 166/77.53 |
| 6,550,128 | B1 | * | 4/2003 | Lorenz | |

* cited by examiner

*Primary Examiner*—Eric Compton
(74) *Attorney, Agent, or Firm*—Patterson & Sheridan

(57) ABSTRACT

The present invention provides an apparatus for attachment to pipe handling arm, comprising a clamp for gripping a tubular and a guide for aligning said tubular with another tubular prior to connection thereof, characterized in that said clamp and said guide are movable relative to each other in a direction longitudinal of the tubular, the arrangement being such that said tubular can be brought closer to said another tubular in a direction longitudinal of the tubular.

18 Claims, 2 Drawing Sheets

APPARATUS AND METHOD FOR HANDLING OF TUBULARS

CROSS-REFERENCE TO RELATED APPLICATIONS

This application is a continuation of U.S. patent application Ser. No. 09/600,764, filed Sep. 19, 2000 U.S. Pat. No. 6,550,128 which is a 371 of PCT/GB99/00432 filed Feb. 11, 1999. The aforementioned related patent application is herein incorporated by reference.

BACKGROUND OF THE INVENTION

Field of the Invention

Embodiments of the present invention generally relate to an apparatus or attachment to a pipe handling arm and to a method of handling a tubular.

SUMMARY OF THE INVENTION

Pipe handling apparatus generally comprises a pipe handling arm and a clamp. The pipe handling arm is fixed at one end to a derrick or to a rig floor of a drilling rig. The other end of the pipe handling arm is free to move in at least one plane, and usually two or three planes. The clamp is attached to the free end of the pipe handling arm In use, the free end of the pipe handling arm is swung over to a pipe rack. The clamp clamps on to a tubular and then picks the tubular up and maneuvers it into a position generally over an upper section of a tubular string at the well centre. Typically the tubulars are not in perfect alignment due to tolerance in the pipe handling arm. In order to ensure correct alignment a stabbing guide is then strapped around the threaded box of the upper section of the tubular string. The threaded pin of the tubular is then lowered into the threaded box of the upper section of the tubular string, and is guided into alignment therewith by the stabbing guide.

Although it only takes a relatively short time to mount and remove a stabbing guide it would be desirable to reduce this time because of the high costs associated with the running of a drilling rig.

In order to reduce this problem the present invention provides a clamp for gripping a tubular, characterised in that said apparatus further comprises means for, in use, aligning said tubular with another tubular prior to connection thereof.

The tubulars could be casing, liner or other type of pipe and especially large diameter tubulars, for example 36" casing.

Preferably, said means comprises a guide.

Advantageously, said clamp and said guide are movable in relation to each other, the arrangement being such that, in use, said tubular can be brought closer to said another tubular.

Preferably, said clamp and said guide are arranged on a strut.

Advantageously, at least one of said clamp and said guide is movable along said strut by a hydraulic piston and cylinder.

Alternatively, at least one of said clamp and said guide is movable along said strut by a pneumatic piston and cylinder.

Preferably, said strut is divided into a first portion and a second portion and said second portion is offset from said first portion.

Advantageously, said apparatus further comprises a second clamp which is in a fixed relation to said clamp.

Preferably, said clamp(s) comprise jaws movable between an open and a closed position.

Advantageously, said apparatus further comprises a hydraulic piston to move said jaws between their open and closed positions.

Preferably, said jaws comprise cylindrical rollers, to facilitate rotation of said tubular whilst inhibiting axial movement thereof.

Advantageously, said apparatus comprises a lug for attachment to a pipe handling arm.

Preferably, said guide comprises a clamp.

The present invention also provides a pipe handling arm provided with an apparatus in accordance with the present invention.

The present invention also provides a method of handling a tubular to be connected to another tubular, which method comprises the steps of:

gripping said tubular with an apparatus in accordance with the present invention, and using said apparatus to align said tubular with said another tubular.

BRIEF DESCRIPTION OF THE DRAWINGS

For a better understanding of the present invention, reference will now be made, by way of example, to the accompanying drawings in which.

DETAILED DESCRIPTION OF THE PREFERRED EMBODIMENT

Figure 1A:
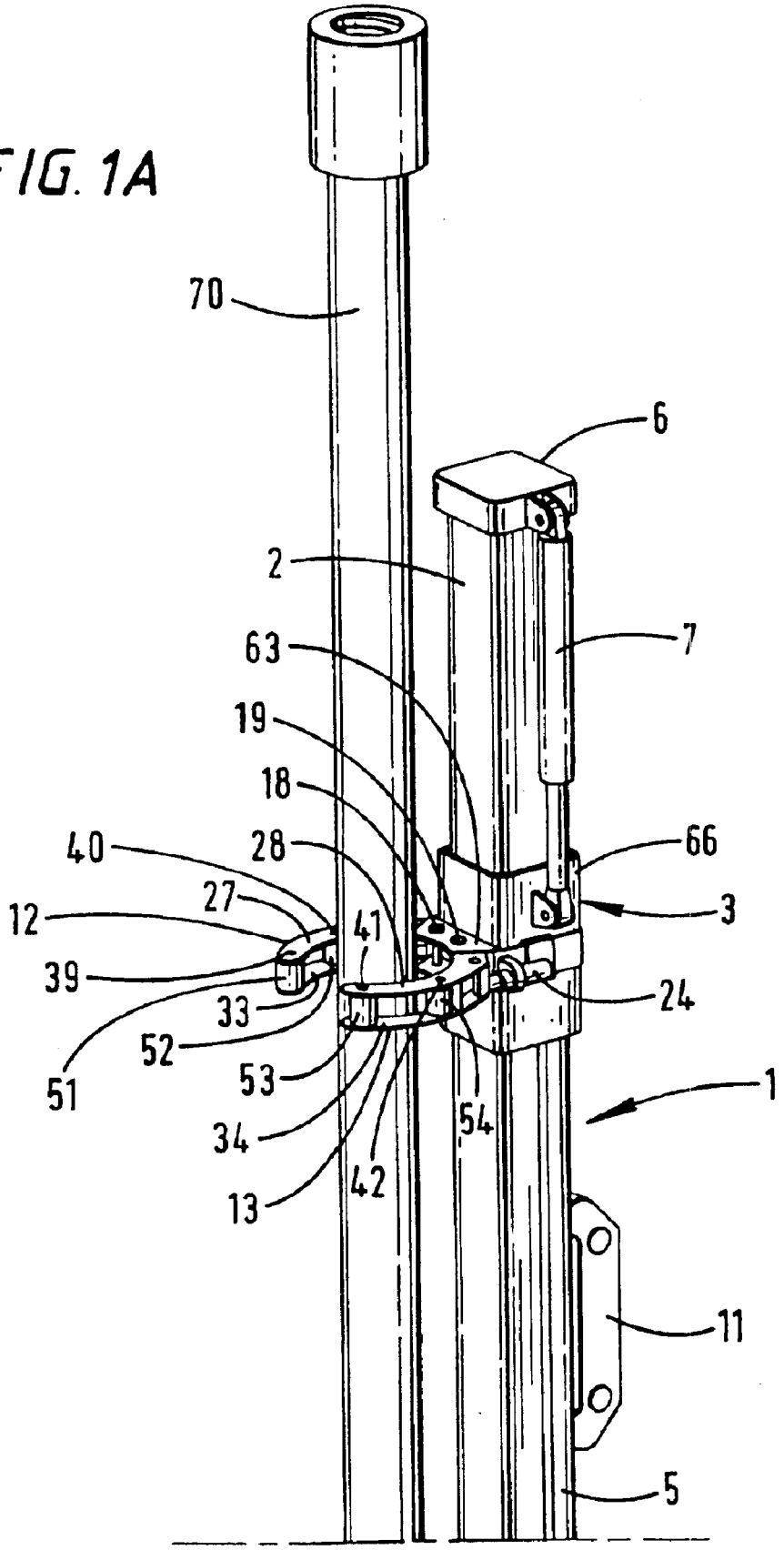
FIG. 1A shows a top portion of an apparatus according to the present invention in use.
Figure 1B:
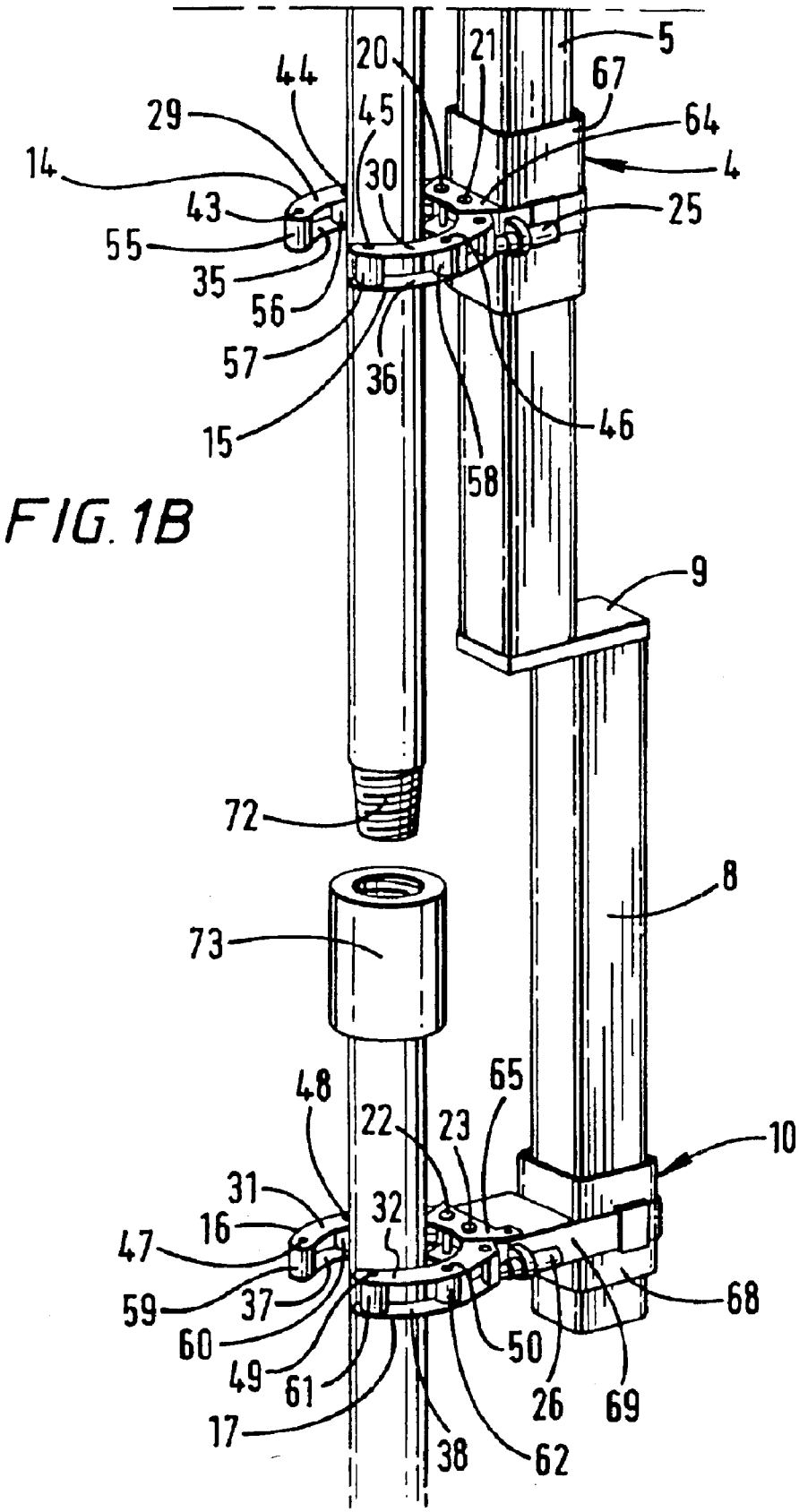
FIG. 1B shows a bottom portion of the apparatus according to the present invention in use.

Referring to the drawings there is shown an apparatus which is generally identified by reference numeral 1.

The apparatus 1 comprises a substantially vertical box-section upper strut 2 which has longitudinally spaced upper and lower clamping units 3 and 4 slidably mounted thereon. The upper and lower clamping units 3 and 4 are linked by a bar 5. The upper clamping unit 3 is attached to the piston of a hydraulic piston and cylinder 7. Activation of the hydraulic piston and cylinder 7 moves the upper and lower clamping units 3 and 4 along the upper strut 2.

A substantially vertical box-section lower strut 8 is attached to the upper strut 2 by a plate 9. The lower strut 8 is set back from the upper strut 2. A guide in the form of a clamping unit 10 is arranged near the lower end of the lower strut 8.

The apparatus 1 is connectable to a standard pipe handling arm (not shown) in place of the known clamping device described hereinbefore via lug 11.

Each clamping unit 3, 4, 10 comprises two jaws 12, 13; 14, 15; 16, 17; each jaw 12 to 17 being pivotable about a respective pin 18, 19, 20, 21, 22, 23 by a hydraulic piston 24, 25, 26.

Each jaw 12 to 17 comprises an upper plate 27 to 32 and a lower plate 33 to 38 which are separated by bolts 39 to 50 onto which cylindrical rollers 51 to 62 are mounted so that the longitudinal axis of the cylindrical rollers 51 to 62 is substantially perpendicular to the upper and lower plates 27 to 38.

Each jaw 12 to 17 is attached to a lug 63, 64, 65. Lugs 63 and 64 are welded to respective sleeves 66 and 67 which are slidalbly arranged on the upper strut 2. Lug 65 is welded to an intermediary section 69 which in turn is welded to sleeve 68. The sleeve 68 is fixed to the lower strut 8 by grub screws (not shown). The sleeve 68 may however be moved along lower strut 8. The jaws 12 to 17 of the clamping units 3, 4, 10 are substantially in vertical alignment with each other, and preferably to within a tolerance of a few millimetres.

In use, the apparatus 1 is connected to a pipe handling arm via lug 11. The pipe handling arm is generally movable in three planes. Such pipe handling arms are currently supplied by Varco BJ™ such as the PLS-3™ Automatic pick-up/Lay-downs system and Martine Hydraulics™ such as the Eagle™ and Eagle Light™ transfer system.

A tubular 70 to be connected to the upper end of a tubular string 71 is picked up by the jaws 12, 13, 14, 15 of the clamping units 3, 4 from a rack (not shown). The jaws 12, 13, 14, 15 of the clamping units 3, 4 move about pins 18, 19, 20, 21 by activation of the hydraulic pistons 24, 25. The rollers 51 to 58 engage with the tubular 70. The upper end of the tubular string 71 is held in a spider (not shown) in the rig floor (not shown). The tubular 70 is then brought into approximate alignment, for example within a few centimetres of the upper section of the tubular string 71 by manipulation of the pipe handling arm to which apparatus 1 is connected.

The jaws 16, 17 of the clamping unit 10 move about pins 22, 23 by activation of the hydraulic pistons 26 and rollers 55 to 58 move circumjacent and engage the upper section of the tubular string 71. As the rollers 55 to 58 move into engagement with the tubular string 71 the tubular 70 moves into alignment with the tubular string 71, such movement being permitted by the "slack" in the pipe handling arm. The tubular 70 is now in alignment 5 with the upper section of the tubular string 71 to preferably within a few millimetres. The tubular 70 can now be lowered by activating the hydraulic piston 7. A threaded pin 72 of the tubular 70 locates in the threaded box 73 of the upper section of the tubular string 71.

The lower strut 8 is set back from the tubular 70 and the upper section of the tubular string 71, to allow a tong and a back-up tong (not shown) to be used to screw the threaded pin 72 into the threaded box 73 to make the connection. Alternatively, a top drive (not shown) on the derrick may be used to screw the threaded pin 72 into the threaded box 73. The rollers 51 to 58 allow rotation of the tubular 70 whilst inhibiting a longitudinal movement thereof.

It is envisaged that various modifications may be 20 made to the preferred embodiment including replacing hydraulic piston 7 with a pneumatic piston, which, with the appropriate control apparatus, will be able to compensate for the weight of the tubular 70 and minimise potential damage to the threads as the tubular 70 is lowered into the threaded box 73.

It should be noted that the clamp 10 could be replaced by a guide which could be slidable on the upper section of the tubular string 71 when closed thereabout. However, it is recommended that a clamp 10 should be used.

While the foregoing is directed to embodiments of the present invention, other and further embodiments of the invention may be devised without departing from the basic scope thereof, and the scope thereof is determined by the claims that follow.

What is claimed is:

1. An apparatus for aligning a centerline of a first tubular with a centerline of a second, axially stationary tubular, comprising:

a strut having at least one clamp mateabie to the first tubular, whereby upon mating with the first tubular the centerline of the first tubular is substantially aligned with a centerline of the strut, wherein the strut comprises a first portion and a second portion, wherein said second portion is offset from said first portion; and a lower clamp mateable to the second, axially stationary tubular, the lower clamp disposed on the second portion of the strut and the at least one clamp disposed on the first portion of the strut and movable along the first portion, whereby upon mating the lower clamp with the second, axially stationary tubular, the centerline of the first tubular is substantially aligned with the centerline of the second axially stationary tubular.

2. The apparatus of claim 1, wherein the first portion is connected to the second portion using a plate.

3. An apparatus for use with a pipe handling arm disposed on a rig to align a centerline of a first tubular with a centerline of a second, axially stationary tubular, comprising:

a strut having at least one clamp mateable to the first tubular, whereby upon mating with the first tubular the centerline of the first tubular is substantially aligned with a centerline of the strut, wherein the strut comprises a first portion and a second portion, wherein said second portion is offset from said first portion, and wherein the strut is coupled to the pipe handling arm and the at least one clamp is movable along the first portion; and a lower clamp mateable to the second, axially stationary tubular, the lower clamp disposed on the second portion of the strut, whereby upon mating the lower clamp with the second, axially stationary tubular, the centerline of the first tubular is substantially aligned with the centerline of the second axially stationary tubular.

4. The apparatus of claim 3, further comprising a piston and cylinder assembly for moving the at least one clamp along the strut.

5. The apparatus of claim 3, wherein the first portion is connection to the second portion using a plate.

6. The apparatus of claim 3, wherein the at least one clamp comprises one or more jaws movable between an open position and a closed position.

7. The apparatus of claim 6, further comprising one or more hydraulic pistons for moving the jaws between the open and closed positions.

8. The apparatus of claim 6, wherein the jaws comprise one or more cylindrical rollers to facilitate rotation of the first tubular.

9. The apparatus of claim 8, wherein the first tubular is rotated relative to the one or more jaws.

10. The apparatus of claim 3, further comprising a lug for attachment to the pipe handling arm.

11. A method of aligning a centerline of a first tubular with a centerline of a second, axially stationary, tubular, comprising:

providing a guide having:

a strut having at least one damp mateable to the first tubular, whereby upon mating with the first tubular the centerline of the first tubular is substantially aligned with a centerline of the strut; and a lower clamp mateable to the second, axially stationary tubular, the lower damp disposed on the strut, whereby upon mating the lower clamp with the second, axially stationary tubular, the centerline of the first tubular is substantially aligned with the centerline of the second axially stationary tubular;

coupling the strut to a pipe handling arm disposed on a rig;

engaging the at least one clamp with the first tubular;

positioning the strut and the first tubular proximate the second tubular:

engaging the lower clamp with the second tubular; and aligning the first tubular with the second tubular.

12. The method of claim 11, further comprising suspending the first tubular with a top drive.

13. The method of claim 12, further comprising connecting the first tubular and the second tubular by actuating the top drive to rotate the first tubular.

14. The apparatus of claim 3, wherein the at least one clamp comprises a first clamp and a second clamp in a fixed relation with each other.

15. The method of claim 11, further comprising moving the at least one clamp along the strut.

16. The method of claim 11, further comprising rotating the first tubular relative to the second tubular.

17. An apparatus for aligning a centerline of a first tubular with a centerline of a second tubular, comprising:

a strut having a first portion and a second portion, wherein said second portion is offset from said first portion;

at least one damp coupled to the first portion and movable along a length of the first portion, the at least one clamp adapted to engage the first tubular; and a lower damp coupled to the second portion, the lower clamp adapted to engage the second tubular, whereby upon engaging the at least one clamp with the first tubular and engaging the lower damp with the second tubular, the centerline of the first tubular is substantially aligned with the centerline of the second tubular.

18. The apparatus of claim 17, wherein the first portion is connected to the second portion using a plate.

* * * * *

UNITED STATES PATENT AND TRADEMARK OFFICE

CERTIFICATE OF CORRECTION

PATENT NO. : 7,036,202 B2
APPLICATION NO. : 10/408964
DATED : May 2, 2006
INVENTOR(S) : Georg Lorenz It is certified that error appears in the above-identified patent and that said Letters Patent is hereby corrected as shown below:

Column 4, Claim 1, Line 1: Change “mateabie” to --mateable--

Signed and Sealed this

Fifth Day of December, 2006

JON W. DUDAS
*Director of the United States Patent and Trademark Office*